US005669724A

United States Patent [19]

Kato

[11] Patent Number: 5,669,724

[45] Date of Patent: Sep. 23, 1997

[54] SIMPLIFIED PAPER PASSAGE IN A PRINTER

[75] Inventor: Hiroyuki Kato, Nagoya, Japan

[73] Assignee: Brother Kogyo Kabushiki Kaisha, Nagoya, Japan

[21] Appl. No.: 635,703

[22] Filed: Apr. 22, 1996

[30] Foreign Application Priority Data

May 16, 1995 [JP] Japan ..... 7-116979
Nov. 16, 1995 [JP] Japan ..... 7-298415

[51] Int. Cl.[6] ..... B41J 11/50

[52] U.S. Cl. ..... 400/605; 400/624; 400/642

[58] Field of Search ..... 400/624, 625, 400/611, 634, 636, 642, 605

[56] References Cited

U.S. PATENT DOCUMENTS 4,732,501 3/1988 Angst et al. ..... 400/605
5,100,251 3/1992 Yasuoka ..... 400/605

FOREIGN PATENT DOCUMENTS 7-112564 5/1995 Japan .

OTHER PUBLICATIONS

"Compact Printer With Automatic Paper Feed" IBM Tech. Discl. Bulletin, vol. 27, No. 7B, Dec. 1984 pp. 4292–4293.

*Primary Examiner*—Eugene H. Eickholt
*Attorney, Agent, or Firm*—Oliff & Berridge

[57] ABSTRACT

Formed on a base frame of a printer is a guide surface which forms one surface of a portion of a paper passage. A pair of rollers of a transferring device are supported proximate one end. A cover frame and a carriage unit are each formed with a guide member, and an urging device, for example, a movable guide lever, and a roller are supported thereby. By mounting the carriage unit and the cover frame onto the base frame from above there is formed a portion of the paper passage, that is a passage for the feed of the paper, in a space where the guide members are spacedly opposed to the guide surface. At the same time, the movable guide lever and the roller are urged against a roller of the transferring device. After assembly, a paper storage tray of an automatic paper feeder is inserted into the printer in a position behind the paper passage.

21 Claims, 6 Drawing Sheets

SIMPLIFIED PAPER PASSAGE IN A PRINTER

BACKGROUND OF THE INVENTION

1. Field of the Invention

The invention relates to a printer and, more particularly, to a printer of the type wherein printing paper is introduced manually to a printing head along a paper passage, for example, the paper passage being simplified in structure and the printer capable of being assembled easily.

2. Description of Related Art

There is known a printer wherein printing paper is wound around a platen and a printer wherein printing paper is transferred substantially horizontally.

In the former printer, a platen for supporting and transferring printing paper, a guide plate, called a paper pan, for introducing printing paper onto the outer periphery of the platen, and a guide shaft, which slidably supports a carriage having a printing head thereon, are fixed to a metallic frame disposed within an outer case.

In the printer referred to above, guide plates are disposed in a vertically spaced relationship to each other and in front and rear positions, respectively, in the paper transferring direction of a fixed platen to define a paper passage therebetween. A plurality of pairs of rollers are arranged in parallel with the guide plates and fixed at both right and left ends bridgewise to a pair of metallic frames. Further, a guide shaft which slidably supports a carriage is fixed bridgewise to a pair of metallic frames.

In a printer provided with an automatic paper feeder, the paper feeder is fixed to an upper portion of a platen and printing sheets which have been fed one by one are introduced to the platen through an opening of an outer case. When another printing paper is to be fed manually, this is done by switching from the paper passage for the automatic paper feeder to a manual paper passage.

Further, in the former printer referred to above, it is necessary that a guide plate, called a paper pan, and a carriage guide shaft be fixed bridgewise between both right and left side walls of a metallic frame and that the so-assembled structure be subsequently mounted into an outer case together with the platen and the printing head. Also in the latter printer so referred to above, a guide plate, a roller and a carriage guide shaft are fixed between a pair of metallic frames. Thus, not only are many components required but it is also necessary to provide many assembling steps.

In the printer equipped with an automatic paper feeder as referred to above, the structure of the manual paper passage is more complicated.

Further, in all of the above conventional printers, since the paper pan and the guide plate are fixed bridgewise to a metallic frame(s) to ensure rigidity, the carriage traveling accuracy is apt to be influenced by any twisting of the metallic frame(s), and high levels of fabrication and assembly techniques are required for improving the print quality.

SUMMARY OF THE INVENTION

An object of the invention is to provide a printer capable of eliminating the above-mentioned problems of the prior art, simplifying the structure of the paper passage, and capable of being assembled easily.

According to the invention, in order to achieve the above-mentioned object, there is provided a printer including a base frame, a transferring device supported by the base frame to transfer a printing paper along a paper passage, a printing head adapted to perform a printing operation for the paper, and a carriage frame which supports a carriage with the printing head carried thereon in such a manner that the carriage is slidable in a direction perpendicular to the paper transferring direction of the transferring device. In this printer according to the invention, a guide surface which constitutes one surface of a portion of the paper passage is formed on the base frame, and the carriage frame is provided with a guide member opposed to and spaced from the guide surface to define therebetween a portion of the paper passage introducing the printing paper to the transferring device.

In the above structure according to the invention, the guide surface is formed on the base frame, while the guide member is provided on the carriage frame side, and in this state the carriage frame is mounted to the base frame, whereby the guide surface and the guide member are opposed to and spaced from each other, thus making it possible to form a portion of the paper passage therebetween. As a result, the printing paper can be introduced to the transferring device along both the guide surface and the guide member and printed by the printing head.

In the invention, as set forth above, by mounting the carriage frame to the base frame, the guide surface on the base frame and the guide member of the carriage frame are opposed to and spaced from each other to form a portion of the paper passage therebetween. Thus, the structure of the paper passage is simplified and the printer assembling operation can be done easily.

BRIEF DESCRIPTION OF THE DRAWINGS

Preferred embodiments of the invention will be described in detail with reference to the accompanying drawings wherein.

DETAILED DESCRIPTION OF THE PREFERRED EMBODIMENTS

Figure 2:
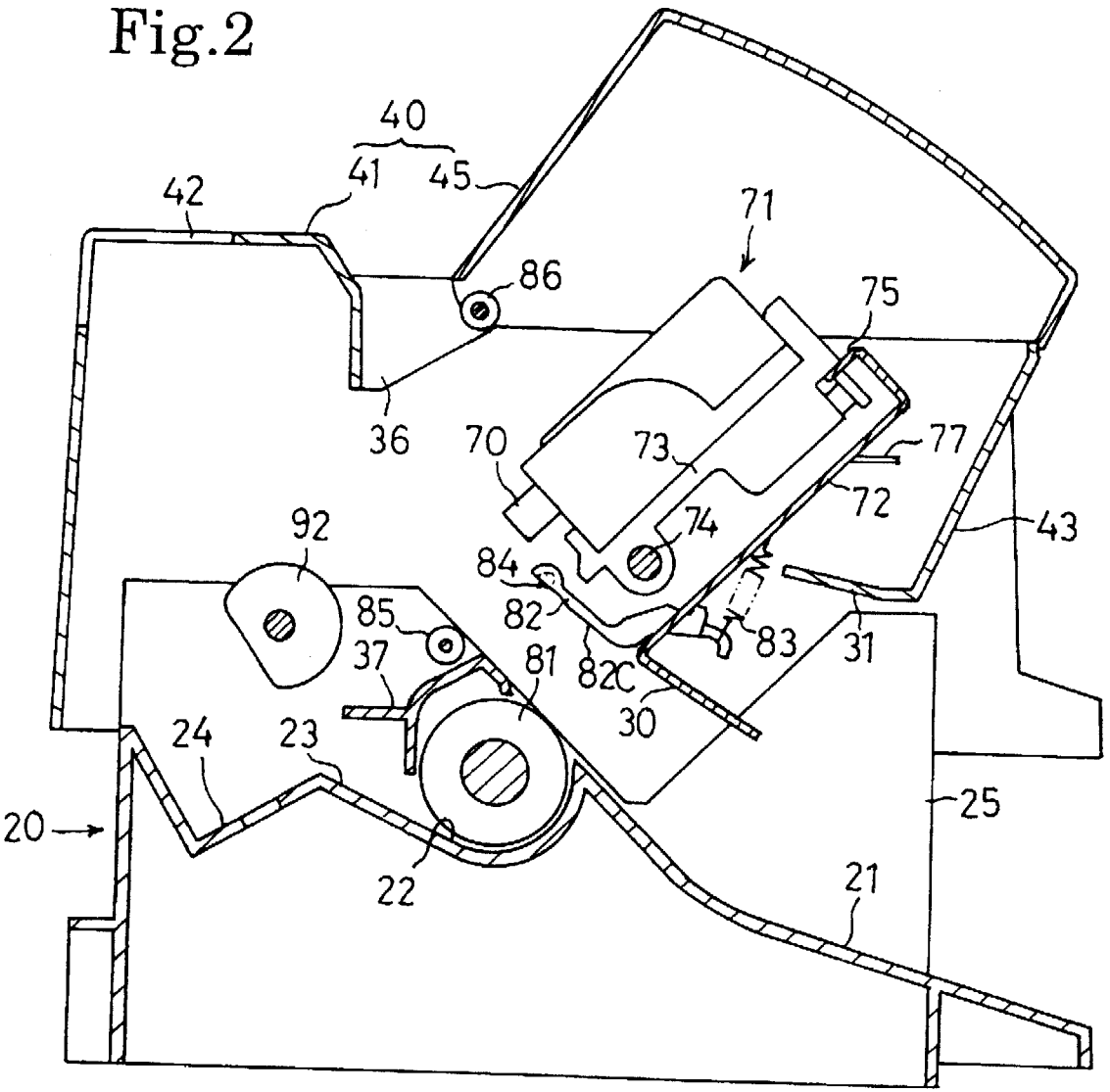
FIG. 2 is a sectional side view of the printer of the first embodiment in an exploded state.
Figure 3:
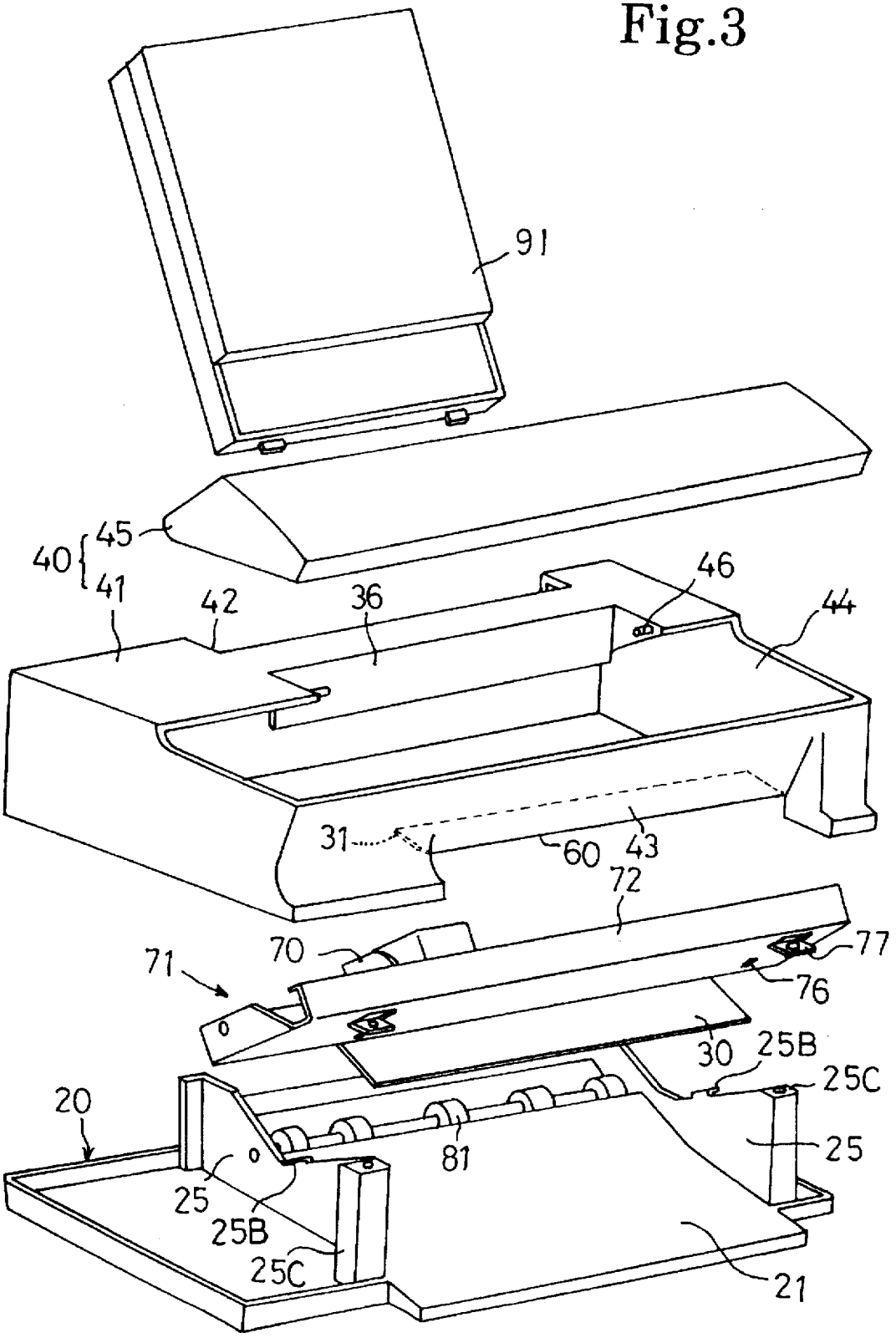
FIG. 3 is an exploded perspective view of the printer of the first embodiment.

The first embodiment of the invention will be described with reference to FIGS. 1 to 3.

Figure 1:
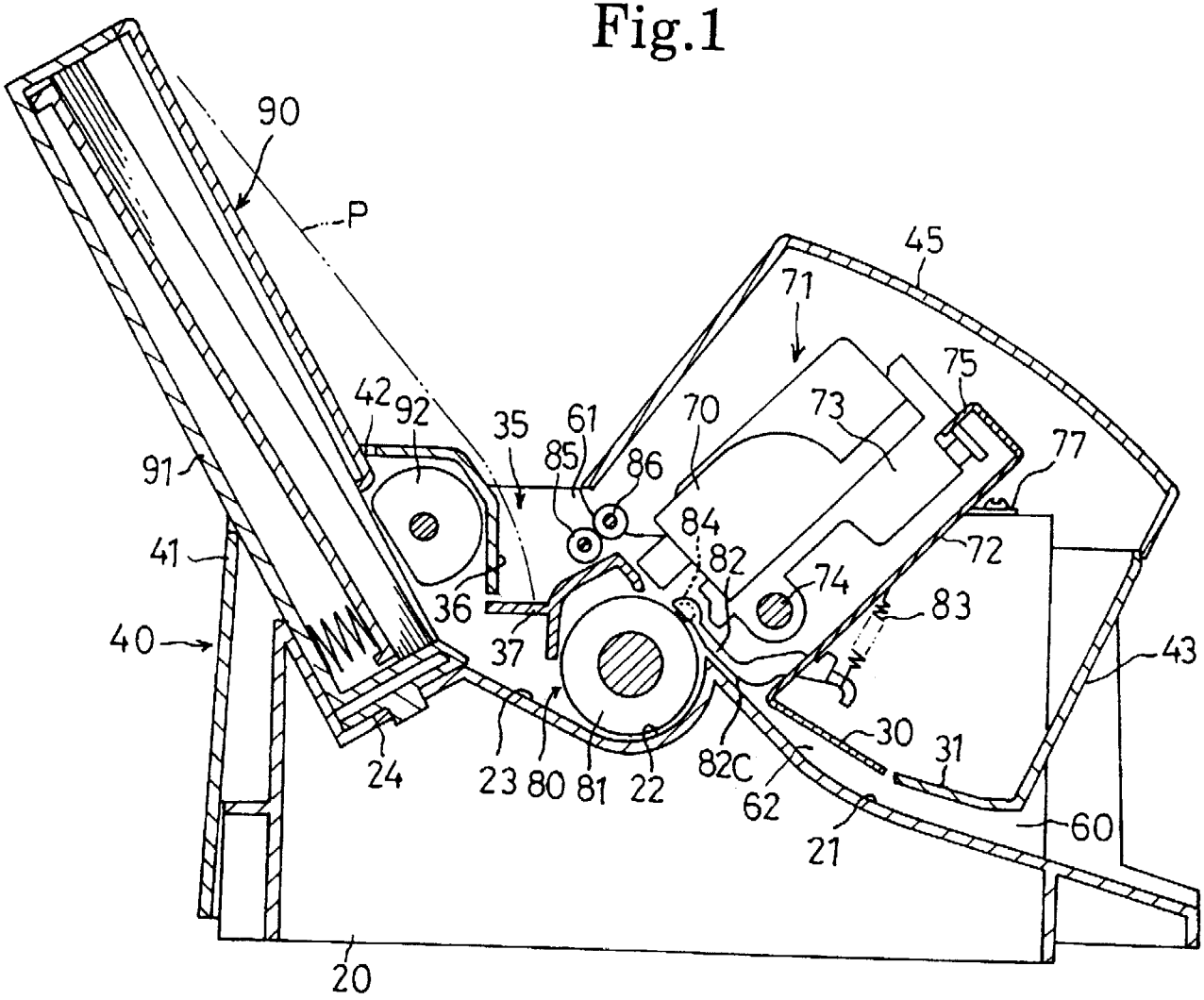
FIG. 1 is a sectional side view of a printer according to a first embodiment.

In FIG. 1, a printer according to the first embodiment is illustrated in a state of normal operation. In this state it is assumed that the right-hand side of the figure is the front of the printer, the left-hand side is the rear of the printer, the top is the upper side of the printer, the bottom is the lower side of the printer.

The outer structure of the printer comprises a base frame 20 and a cover frame 40 which covers the base frame 20 from above. In the front face of the printer is formed a paper insertion opening 60, while in the upper surface of the printer is formed a paper discharge opening 61. A generally flat paper passage 62, extending in an inclined state between the openings 60,61, is formed within the printer. As in the conventional printers, each time one line is printed by a printing head 70, the paper which has been inserted into the paper passage is transferred to the next line by means of a transferring device 80. Paper from an automatic paper feeder 90, disposed behind the paper passage 62, is also fed to the transferring device 80 and is transferred and printed likewise.

The printing head 70 is of an ink jet type wherein ink is jetted toward printing paper. The printing head 70 is carried on a carriage unit 71. The carriage unit 71 is supported as a single unit by means of a metallic carriage frame 72 which extends in the paper width direction, namely, into the figure as viewed. On the carriage frame 72, a carriage 73 carries the printing head 70 thereon and is slidably supported by guide bars 74,75 in a direction perpendicular, i.e. into the figure as viewed, to the paper transferring direction of the transferring device 80. The guide bar 74 located on the side close to the printing paper is fixed bridgewise between the right and left side walls 25,25 of the carriage frame 72, while the other guide bar 75 is formed by bending into a U-shape a longitudinal end portion of the carriage frame 72 on the side spaced away from the printing paper. The carriage 73 carrying the printing head 70 thereon is driven along the guide bars 74,75, namely in the line direction, by means of a drive source (not shown).

The transferring device 80 comprises transferring means disposed on the upstream and the downstream sides, respectively, in the paper transferring direction with respect to the printing head 70. The upstream side transferring means comprises rollers 81 supported bridgewise between right and left side walls 25,25 of the base frame as will be described later and an urging means, for example, a movable guide lever 82, for urging the printing paper against the roller 81. A roller 84 is supported at a free end portion of the movable guide lever 82 to be in contact with a roller 81. The movable guide lever 82 is supported swingably by the carriage frame 72 and is urged in a direction of contact with the roller 81 by a suitable urging means, for example, a spring 83. The urging means may be formed of an elastic material such as an elastic synthetic resin. In such a case, the spring 83 and the roller 84 may be omitted.

The downstream side transferring means, which is disposed near the discharge opening 61, comprises a roller 85 supported bridgewise between right and left side walls 25,25 of the base frame and an urging means, for example, a roller 86 for urging the printing paper to the roller 85. The roller 86 is supported by an open/close cover portion 45 of the cover frame which will be described later. The rollers 81,84,85,86 and the movable guide lever 82 are arranged substantially throughout the overall paper width direction of the paper passage, i.e. into the figure as viewed. The upstream and downstream side rollers 81,85 are rotated by means of a drive source (not shown) and the printing paper is transferred toward the discharge opening 61 while being kept in a planar state between the rollers 81,85.

According to the structure of the base frame 20, a guide surface 21 which forms the lower side of the front half portion of the paper passage 62, a semi-cylindrical recess 22 which surrounds the lower portions of the roller 81, and an inclined guide surface 23 which is inclinedly extended between the recess 22 and a fixing seat 24, the fixing seat 24 for seating a paper storage tray 91 of the automatic paper feeder 90, are integrally formed successively in order from the front and rear direction of the printer. Also formed integrally are side walls 25,25 which rise on both right and left sides of the guide surface 21, recess 22, inclined guide surface 23 and fixing seat 24. The guide surface 21, recess 22, inclined guide surface 23 and fixing seat 24 are formed in an upwardly open state.

The guide surface 21 defines the paper insertion opening 60 between the front end of the base frame 20 and the cover frame 40. The guide surface 21 is inclined so as to rise toward a position close to the transferring device 80. The rollers 81,85 are arranged so that their outer peripheries are positioned approximately in an extending direction from the rising upper end of the guide surface 21.

The carriage unit 71 is fixed bridgewise between the upper ends of both right and left side walls 25,25 in the upper opening portion of the guide surface 21. For example, in the portion close to the paper passage 62 of the carriage frame 72, apertures 76 (FIG. 3) are engaged to inverted L-shaped lugs 25B of the side walls, while in the portion of the carriage frame spaced away from the paper passage 62, raised pieces 77 of the carriage frame are fixed to strut portions 25C of the side walls using fixing elements, such as bolts or rivets. The upper ends of the right and left side walls 25,25 are inclined in a direction nearly perpendicular to the paper passage 62. In the above fixed state, the printing head 70 is opposed approximately perpendicularly to the paper passage 62 from above. In the case of an ink jet type head, an ink droplet is dropped from above to the printing paper, so each dot is formed beautifully and good printing results.

A guide member 30 is positioned above the guide surface 21 and is formed by bending, toward the upstream side of the paper transferring direction, an end portion of the carriage frame 72 closest to the paper passage 62. A guide member 31 of the cover frame 40 is formed so as to extend from the upper edge of the paper insertion opening 60 toward the downstream side of the paper transferring direction. Both guide members 30,31 are arranged substantially in a continuous form to be close to each other at their end portions. A portion of the paper passage 62, namely a manual paper passage, is formed in the space between the guide surface 21 and the guide members 30,31. Consequently, the structure of the paper passage 62 is simplified and the assembling work becomes easier.

One of the guide members 30,31 may be extended up to the position and to include the portion covered by the other guide member to omit the other. Since the guide bar 75 and guide member 30 are formed in a bent state on both front and rear sides of the carriage frame 72, the strength of the carriage frame is enhanced and the stability of the printing operation is improved.

A surface 82C of the movable guide lever 82, which surface is spacedly opposed to the guide surface 21, also functions as a guide member for forming the paper passage 62.

In a lower position behind and adjacent to the paper discharge opening 61 is formed a concave receptacle portion 35 for receiving therein the lower portion of printed paper P. The receptacle portion 35 is formed by covering the bottom of a recess formed in the upper surface of the cover frame 40 with a member 37 of a small width mounted above the rollers 81. The back of the printed paper P is received while resting against the front wall of the paper storage tray 91. The member 37 also extends between that of the upstream and downstream rollers 81,85 of the transferring device 80 and also functions as a guide means until the leading end of paper reaches the downstream roller 85.

The automatic paper feeder 90 is disposed on the side opposite to the guide surface 21 with the transferring device therebetween, that is, behind the paper passage 62 when seen from the front side. The paper storage tray 91 is removably mounted onto the fixing seat 24 of the base frame through an opening 42 formed in the cover frame 40. Paper feed rollers 92 are supported between both side walls 25,25 of the base frame. In a mounted state of the paper storage tray 91 to the fixing seat 24, the paper feed rollers 92 are opposed to stacked sheets of paper in the paper storage tray 91 and rotate to feed the stacked sheets one by one toward the inclined guide surface 23.

The cover frame 40 is formed in the shape of a box whose lower side is open, and it is fixed to the base frame 20 so as to cover the transferring device 80 and the paper feed rollers 92. In order for printing paper to be easily set on the guide surface 21 of the base frame 20, a recess 43 is formed on the front side of the cover frame 40 in a position opposed to the front end portion of the guide surface 21, and a cutout portion for forming the paper insertion opening 60 is formed in the recess 43.

The portion of the cover frame 40 opposed to the upper portion of the carriage unit 71 is formed as the open/close cover portion 45. The open/close cover portion 45 is mounted to cover an opening 44 which is formed in a cover frame body portion 41 for exposure of the carriage unit 71, and is connected to the body portion 41 through hinges 46 so that it can be opened and closed. By opening the cover portion 45 it is possible to replace an ink cartridge, for the supply of ink to the printing head 70, or to replace the printing head 70.

In the case where a manually fed printing paper is to be printed, the paper is put on the guide surface 21 of the base frame and is inserted along the guide surface 21 until its leading edge comes into abutment with the nip of the rollers 81,84. At this time, even if the leading edge of the paper has risen up or floats, it is pressed down and guided to the nip by the guide members 30,31 and the surface 82C of the movable guide lever 82. Thereafter, with the rotation of the rollers 81,85, the paper is conveyed to a position beneath the printing head 70 whereupon the printing operation of the printing head is started. The printed paper is discharged from the discharge opening 61 and is received in the receptacle portion 35. The paper passage 62 is generally flat and, unlike the paper passage extending from the automatic paper feeder 90, which will be described later, it is not curved along the radius of the rollers 81, thus permitting printing for a thicker paper than the paper stored in the automatic paper feeder 90.

Further, since paper is inserted from the front opening 60 of the cover film 40 and is discharged from the upper opening 61 through the inclined passage, the insertion of paper is easy and the result of the printing is easy to see.

In the case where paper is fed from the automatic paper feeder 90 by the paper feed rollers 92, the paper passes below the rollers 81 and is fed, until the leading edge of the paper comes into abutment with the nip of the rollers 81,84, along the surface 82C of the movable guide lever 82. Thereafter, the paper is transferred by the transferring device 80 and printed in the same way as above.

The work of assembling the printer can be effected by mounting the rollers 81,85,92 to the base frame 20, fixing the carriage unit 71, including the movable guide lever 82 bridgewise to the side walls 25,25, and then covering the structure with the cover frame 40. The paper storage tray 91 can be inserted into the printer interior through the opening 42. Thus, by merely placing the carriage unit 71 and the cover frame 40 onto the base frame from above in the aforesaid manner, the guide members 30,31 oppose the guide surface 21 and the rollers 84,86 come into contact with the rollers 81,85, respectively, to form the paper passage 62. In addition, the automatic paper feeder is disposed substantially on an opposite side to the guide surface 21 with respect to the transferring device, so in the assembling work there is no fear of interference of the carriage frame with the automatic paper feeder. Moreover, since the manual paper passage and the passage extending from the automatic paper feeder are independent of each other, the result is a simple structure.

Although each of the rollers 81,84,85,86 has been described as a plurality of rollers spaced along a roller shaft, each roller 81,84,85,86 may be a unitary roller extending substantially the entire length of the roller shaft.

Figure 4:
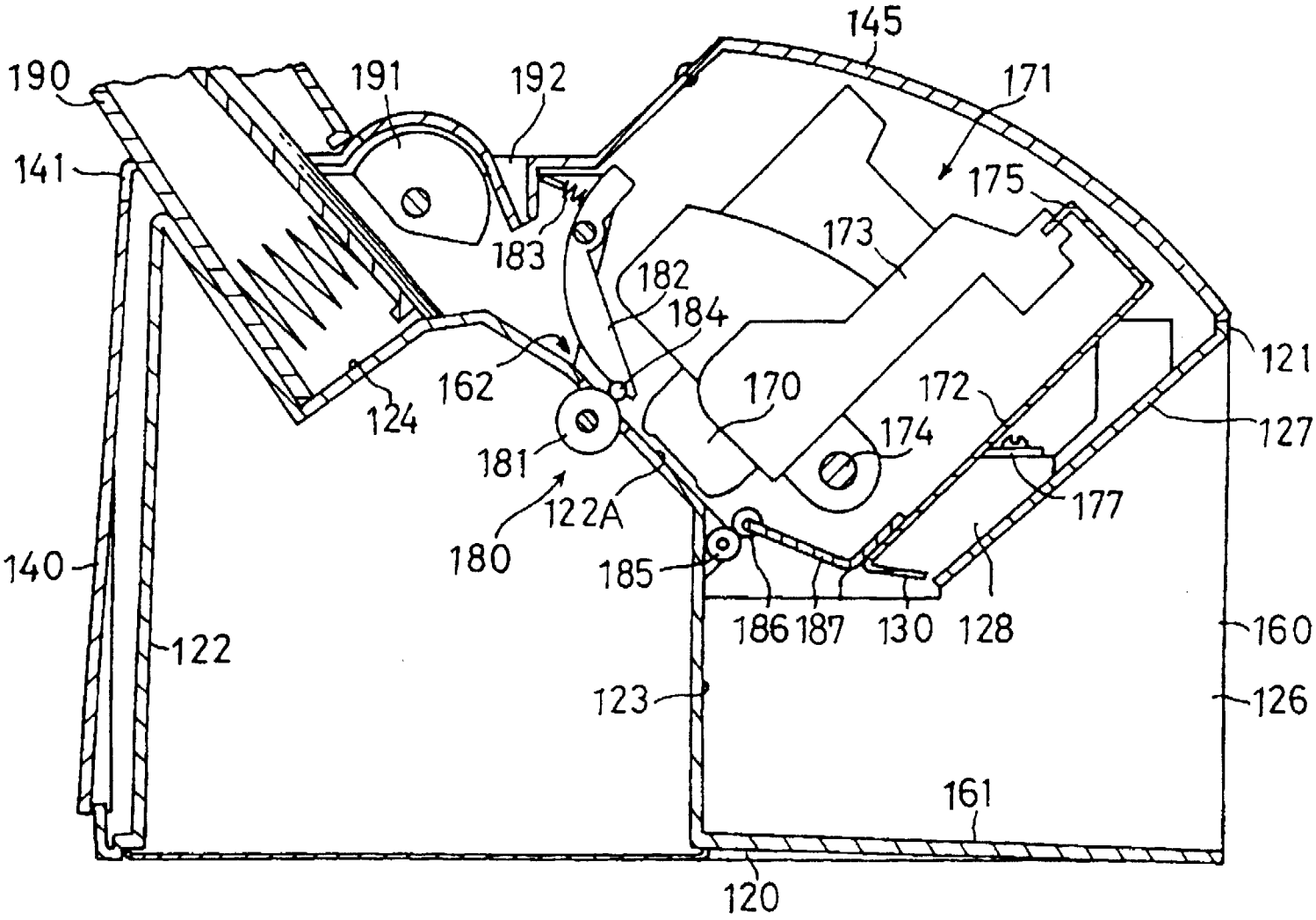
FIG. 4 is a sectional side view of a printer according to a second embodiment.
Figure 5:
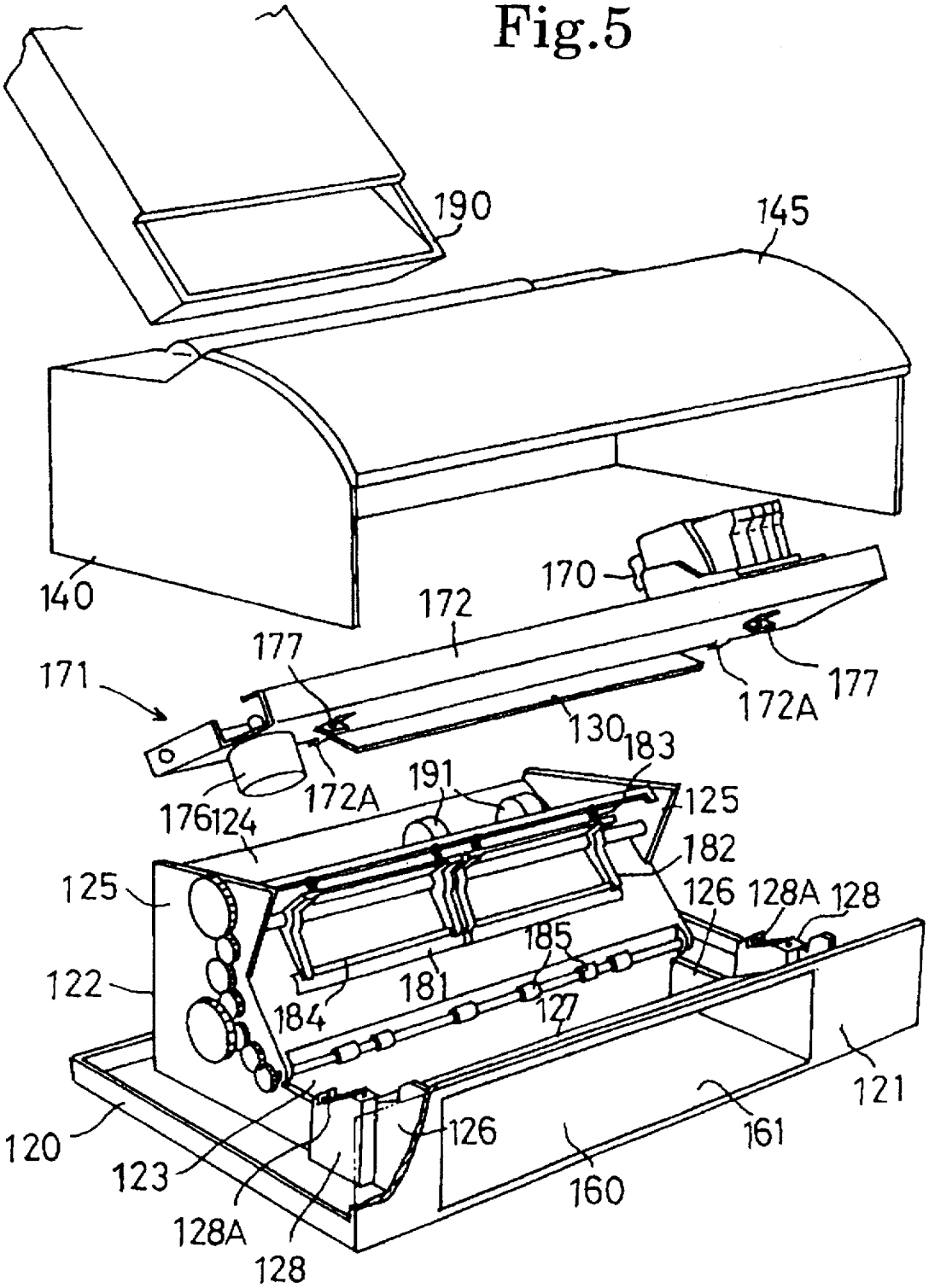
FIG. 5 is an exploded perspective view of the printer of the second embodiment.
Figure 6:
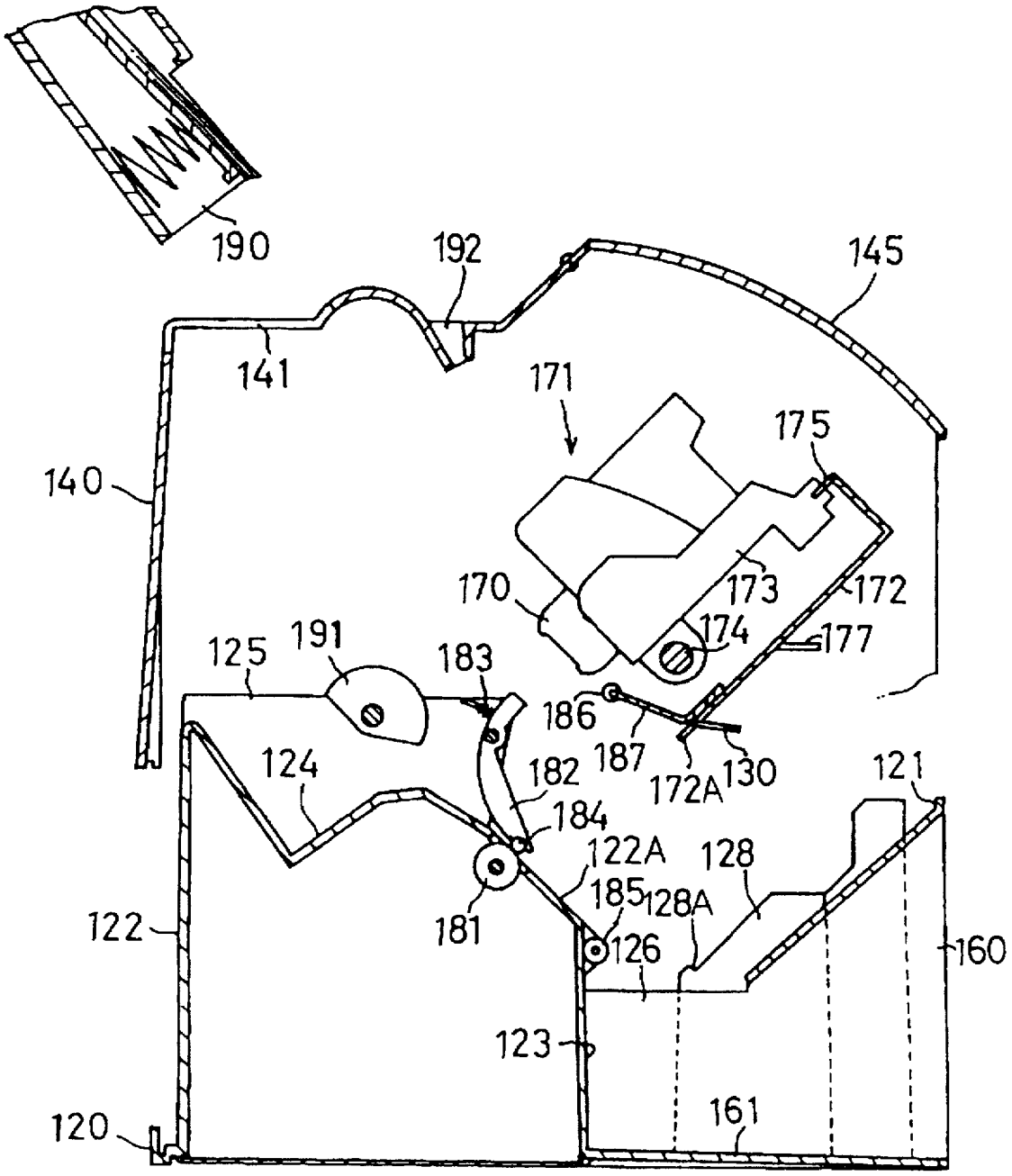
FIG. 6 is a sectional side view of the printer of the second embodiment in an exploded state.

A printer according to the second embodiment of the invention will be described below with reference to FIGS. 4 to 6.

The outer structure of this printer comprises a base frame 120 and a cover frame 140 which covers the base frame 120 from above. A front wall 121 which constitutes the front side of the printer is formed integrally as a rising wall from the base frame 120, and a paper discharge opening 160 is formed in the front wall 121. Further, a generally flat paper passage 162 extends in a forwardly declining state from a paper cassette 190, which has been inserted through an opening formed in a rear, an upper surface portion of the cover frame 140, or from a manual insertion opening 192 toward the discharge opening 160. As in the conventional printer, each time printing paper, which has been inserted into the paper passage 162, is printed one line by means of a printing head 170, it is advanced to the next line by means of the transferring device 180.

The printing head 170 is of an ink jet type wherein ink is ejected toward the printing paper and it is provided in a single printing unit 171. The printing unit 171 comprises a carriage frame 172 made of a metallic plate and extending in a direction perpendicular to the paper transferring direction, namely into and out of the FIG. 4. Guide bars 174,175 extend in the same direction as the carriage frame 172 and a carriage 173, which carries the printing head 170 thereon, is slidably supported by the guide bars 174,175 for movement along the guide bars 174,175. The guide bar 174 on the side closest to the printing paper is fixed bridgewise between the right and left side walls 125,125 (FIG. 5) of the carriage frame 172. The guide bar 175 is formed by bending in a U-shape an end portion of the carriage frame 172 on the side spaced away from the paper. The carriage 173 which carries the printing head 170 thereon is driven in the direction perpendicular to the paper feeding direction by means of a motor 176 (FIG. 5).

The transferring device 180 is structured as follows. The upper surface of a box-like member 122 formed projectingly on a rear, upper surface portion of the base frame 120 is formed as a guide surface 122A with an open upper portion to constitute one surface of the inclined paper passage 162. Along the guide surface 122A are arranged roller pairs respectively on upstream and downstream sides of the printing head 170. The upstream-side roller pair is composed of a roller 181 and a roller 184 supported by a movable guide lever 182. The movable guide lever 182 is supported swingably and is urged in a direction of contact with the roller 181 by means of a biasing means, for example, a spring 183. The downstream-side, or the discharge-side, roller pair is composed of rollers 185 and an urging means, for example, a spur roller 186 having a large number of sharp projections on its outer periphery, for urging paper against the roller 185. The spur roller 186 is supported by an arm 187 fixed to the carriage frame 172, while the other rollers 181,185 and the movable lever 182 are supported bridgewise between right and left side walls 125,125 of the box-like member 122. The rollers 181,184,185,186 and the movable lever 182 are arranged substantially throughout the overall length in the paper width direction, that is, the right and left direction of FIG. 5, of the paper passage 162. The upstream and downstream rollers 181,185 are each rotated by a drive source (not shown) to transfer the printing paper toward the discharge opening 160.

The rollers 181,184,185,186 may each be a plurality of rollers on an axis or may be a single roller having a length substantially equal to the paper width.

In the case where the printing head is of any other type than the ink jet type, the spur roller 186 may be substituted by a known roller, such as a rubber roller, or by an urging means, such as an elastic synthetic resin film or spring.

The box-like member 122 of the base frame 120 has a concave mounting seat 124 contiguous to the rear end of the guide surface 122A. A paper feed cassette 190 is removably loaded onto the mounting seat 124 through an opening 141 of the cover frame 140. Rollers 191 for feeding paper sheets from the stacked sheets of paper in the paper feed cassette 190 are supported by the side walls 125,125 of the box-like member 122. A manual paper insertion opening 192 is formed in the upper surface of the cover frame 140 in a position between the rollers 191 and the movable lever 182.

In the box-like member 122, the front end of the guide surface 122A is inclined downwardly toward the discharge opening 160, terminates in the vicinity of the downstream roller pair of 185 and 186, and is positioned with a difference in vertical height with respect to the bottom wall of the base frame 120. A front wall 123 of the box-like member 122 is erected substantially vertically between the front end of the guide surface 122A and the bottom wall of the base frame 120.

In front of the box-like member 122, namely on the discharge opening 160 side, the discharge opening 160 is formed by the bottom wall of the base frame 120, a pair of side walls 126,126 erected from the bottom wall, and an upper wall 127 formed bridgewise between the upper ends of the side walls 126,126. The side walls 126,126 are formed contiguously to the side walls 125,125 of the box-like member 122. The bottom wall is surrounded by the paired side walls 125,125 and the upper wall 127 is positioned with a difference in height downwardly from the guide surface 122A. The bottom wall acts as a stacker 161 for receiving printed sheets of paper therein in a stacked fashion. Outside the side walls 125,125 are formed a pair of pillar-like mounting portions 128, 128 for mounting of the carriage frame 172.

Lugs 172A formed at the rear edge portion of the carriage frame 172, close to the paper passage, are engaged to holes 128A formed in the mounting portions 128. Raised pieces 177 of the carriage frame are fixed to the upper ends of the mounting portions 128 with a fixing means, such as bolts or rivets. In the fixed state, the printing unit 171 is disposed inclinedly so that the printing head 170 is opposed nearly perpendicularly to the guide surface 122A and so that the printing unit spans the upper wall 127, side walls 125,125 and base frame bottom which surround the discharge opening 160. According to this structure where the printing head is of an ink jet type, because an ink droplet is ejected from above the printing paper, the formation of the dot can be done beautifully and it is possible to obtain a good printing result.

At the end portion of the carriage frame 172, close to the paper passage 162, there is formed a plate-like closure member 130 that is bent toward the discharge opening 160. Together with the plate-like arm 187, which constitutes a second closure member, the closure member 130 is disposed side by side with the upper wall 127 between the guide surface 122A and the upper wall 127. The closure member 130 has a length approximately equal to the bridging length between the side walls 125,125, and in cooperation with the upper wall 127 the closure member 130 covers the upper surface of the paper passage for the paper delivered by the paired discharge rollers 185,186, whereby not only the paper which is apt to curl is prevented from moving in a direction other than the direction of the discharge opening 160 after passing the discharge rollers 185,186, but also the entry of any foreign matter from the discharge opening 160 into the printer is prevented. Further, since the guide bar 175 and the closure member 130 are formed in a bent state longitudinally in front and rear positions of the carriage frame 172, it is possible to enhance the strength of the carriage frame, improving the travel stability of the carriage and improving the print quality.

The cover frame 140 is formed in the shape of a box whose lower and front sides are open. The cover frame 140 is fixed to the base frame 120 so as to cover the printing unit 171, transferring device 180 and paper feed rollers 191. The portion of the cover frame 140 above and opposed to the carriage unit 171 is formed as an open/close cover portion 145. By opening the cover portion 145 it is possible to replace the ink cartridge for supplying ink to the printing head 170 or replace the printing head.

The printing paper fed from the manual insertion opening 192 or fed by the paper feed rollers 191 from the paper feed cassette 190 is held between the paired rollers 181,184 located on the upstream side and is transferred to the position beneath the printing head 170. In this state, printing is performed by the printing head. The thus-printed paper is discharged toward the discharge opening 160 by means of the paired discharge rollers 185,186. After the rear end of the paper passes the rollers 185,186, the paper is received on the stacker 161 which is the bottom of the base frame located between the side walls 125,125.

Since the paper passage 162 is generally flat, it is possible to effect printing for a thick paper such as a post card. Also, because the paper is inserted from the upper surface of the cover frame 140 and is discharged from the front discharge opening 160 through an inclined paper passage, it is easy to insert the paper into the printer and the result of printing is easy to see.

The operation for assembling the printer described above is carried out by mounting the rollers 181,185,191,184, which includes the movable lever 182, to the box-like member 122 of the base frame 120, then fixing the printing unit 171, which includes the spur roller 186 onto the mounting portions 128,128, and covering these components with the cover frame 140. The paper cassette 190 is inserted into the opening 141 when the user uses the printer. Thus, by merely putting the printing unit 171 and the cover frame 140 onto the base frame from above, the closure member 130 and the arm 187 become opposed to the guide surface 121 and the roller 186 comes into contact with the roller 185 to form the paper passage 162.

The upper wall 127 may be omitted and instead the closure member 130 may be extended up to a position close to the front wall 121.

It is to be understood that the invention is not restricted to the particular forms shown in the foregoing embodiments.

Various modifications and alternations can be made thereto without departing from the scope of the invention encompassed by the appended claims.

What is claimed is:

1. A printer, comprising:

a base frame having a pair of opposing side walls;

a paper source;

a transferring device supported by said base frame to transfer paper along a paper passage;

a paper discharge opening;

a printing head adapted to perform a printing operation for the paper;

a carriage frame extending between said pair of side walls for directly supporting a carriage slidably in a direction perpendicular to the paper transferring direction of said transferring device, said carriage carrying said printing head thereon;

a guide surface formed on said base frame, said guide surface constituting one surface of a portion of said paper passage; and a guide member provided on said carriage frame which constitutes a portion of said paper passage for conducting the paper to one of said transferring device and said paper discharge opening, wherein each of said paper source and said paper discharge opening is adjacent an end of the paper passage.

2. The printer according to claim 1, wherein the guide member is integrally formed with the carriage frame.

3. A printer, comprising:

a base frame having a pair of opposing side walls;

a transferring device supported by said base frame to transfer paper along a paper passage;

a printing head adapted to perform a printing operation for the paper;

a carriage frame extending between said pair of side walls for directly supporting a carriage slidably in a direction perpendicular to the paper transferring direction of said transferring device, said carriage carrying said printing head thereon;

a guide surface formed on said base frame, said guide surface constituting one surface of a portion of said paper passage; and a guide member provided on said carriage frame, said guide member being spacedly opposed to said guide surface and constituting a portion of said paper passage between said guide member and said guide surface for guiding the paper to said transferring device.

4. A printer according to claim 3, further comprising:

a cover frame for covering said transferring device, said printing head, said carriage and said carriage frame; and an opening for insertion of the paper into the printer, said opening being formed between said cover frame and said base frame, wherein said guide surface of said base frame forms one side of said opening and extends up to a position close to said transferring device.

5. A printer according to claim 3, wherein said guide member of said carriage frame extends to an upstream side in the paper transferring direction integrally from the carriage frame.

6. A printer according to claim 3, wherein said transferring device includes a roller supported by said base frame and an urging means for urging the paper to said roller, said urging means being supported by said carriage frame.

7. A printer according to claim 6, wherein said guide member of said carriage frame includes a surface opposed to said guide surface on an upstream side in the paper transferring direction relative to the position of contact between said urging means and said roller.

8. A printer according to claim 3, wherein said base frame is open above said guide surface, and said carriage frame is fixed to the open side of the base frame so that said guide member is opposed to said guide surface from above.

9. A printer according to claim 4, wherein said cover frame has a paper insertion opening formed in the front face thereof and also has a paper discharge opening formed in the upper surface thereof, and said paper passage extends substantially in an inclined state between both said openings.

10. A printer according to claim 9, further including an automatic paper feeder which stores therein printing sheets of paper in a stacked fashion and which supplies the stacked sheets of paper one by one to said printing head, said automatic paper feeder being disposed on a substantially opposite side to said guide surface of said base frame with respect to said transferring device.

11. A printer, comprising:

a base frame having a pair of opposing side walls;

a transferring device for transferring paper along a paper passage toward a discharge opening formed at one end of said base frame;

a printing head adapted to perform a printing operation for the paper;

a carriage frame extending between the pair of side walls for directly supporting a carriage slidably in a direction perpendicular to the paper transferring direction of said transferring device, said carriage carrying said printing head thereon; and a closure element provided on said carriage frame to cover an upper side portion of said paper passage.

12. The printer according to claim 11, wherein the closure element is integral to the carriage frame.

13. The printer according to claim 11, wherein said carriage frame comprises a metallic plate, and said closure member is formed by integral bending of the carriage frame.

14. The printer according to claim 11, wherein said discharge opening is formed by being surrounded with a bottom wall of said base frame, a pair of side walls erected from said bottom wall, and an upper wall formed bridgewise between the upper ends of said side walls, and said closure member is disposed side by side with said upper wall in the paper transferring direction.

15. The printer according to claim 11, wherein a bottom wall of said base frame which forms a lower portion of said discharge opening is positioned with a difference in height below an end of said paper passage and constitutes a stacker for receiving printed sheets of paper therein in a stacked fashion.

16. A printer, comprising:

a base frame;

a transferring device for transferring paper along a paper passage toward a discharge opening formed at one end of said base frame;

a printing head adapted to perform a printing operation for the paper;

a carriage frame for directly supporting a carriage slidably in a direction perpendicular to the paper transferring direction of said transferring device, said carriage carrying said printing head thereon;

an upwardly open guide surface formed on said base frame to form one surface of said paper passage; and a closure element provided on said carriage frame to cover an upper surface of said paper passage, wherein said carriage frame is supported by said base frame so that it is opposed to said guide surface from above.

17. The printer according to claim 16, wherein the closure element is integral to the carriage frame.

18. A carriage frame extending between side frames of a printer, comprising:

a flat center section extending between the side frames of the printer;

a first end bent to present a block U-shape in cross-section, an arm of the block U-shape opposite an arm formed by the center section providing a guide bar for a printer carriage; and a second end bent in a direction substantially opposite to a base of the block U-shape first end, the bent second end providing a portion of a paper guide path.

19. The carriage frame according to claim 18, wherein an edge of the bent second end abuts an edge of a cover for the printer.

20. The carriage frame according to claim 18, further comprising an arm mounted to the center section to extend in a direction opposite the second end, the arm and the second end defining a portion of the paper guide path.

21. The carriage frame according to claim 20, further comprising a pressing roller mounted to an end of the arm opposite to the connection to the center section.

* * * * *